US005200738A

United States Patent [19]

Fumoto et al.

[11] Patent Number: 5,200,738

[45] Date of Patent: Apr. 6, 1993

[54] METHOD OF IMAGE DISPLAY WITH SCROLLING CAPABILITY

[75] Inventors: Teruo Fumoto, Kawasaki; Yoshimitsu Kanno, Sagamihara; Shin Yamada; Hiroaki Kotera, both of Kawasaki, all of Japan

[73] Assignee: Matsushita Electric Industrial Co., Ltd., Osaka, Japan

[21] Appl. No.: 611,713

[22] Filed: Nov. 9, 1990

[30] Foreign Application Priority Data

Nov. 9, 1989 [JP] Japan ..... 1-291844

[51] Int. Cl.[5] ..... G09G 1/06

[52] U.S. Cl. ..... 340/726; 340/799

[58] Field of Search ..... 340/726, 724, 721, 723, 340/799, 750

[56] References Cited

U.S. PATENT DOCUMENTS

| | | | |
|---|---|---|---|
| 4,642,621 | 2/1987 | Nemoto et al. | 340/721 |
| 4,642,790 | 2/1987 | Minshull et al. | 340/726 |
| 4,663,617 | 5/1987 | Stockwell | 340/726 |
| 4,862,155 | 8/1989 | Dalrymple et al. | 340/724 |
| 4,872,001 | 10/1989 | Netter | 340/724 |
| 4,922,238 | 5/1990 | Aoki et al. | 340/724 |
| 4,947,370 | 8/1990 | Sugitani | 340/724 |
| 5,006,837 | 4/1991 | Bowers | 340/726 |

FOREIGN PATENT DOCUMENTS 62-135972 6/1987 Japan

*Primary Examiner*—Ulysses Weldon
*Assistant Examiner*—Xiao M. Wu
*Attorney, Agent, or Firm*—Pollock, VandeSande & Priddy

[57] ABSTRACT

A method of data display for a system which includes a main image memory having stored therein data representing a main image, a display memory coupled to temporarily hold data transferred thereto form the main image memory, and a display apparatus for displaying at least a selected portion of the data held in the display memory, whereby while scrolling is being executed in the horizontal or vertical display direction, new data are transferred from the main image memory to the display memory only when the limits of the data currently held in the display memory are exceeded, and with only data for one display line or column being transferred in such a case.

2 Claims, 4 Drawing Sheets

METHOD OF IMAGE DISPLAY WITH SCROLLING CAPABILITY

BACKGROUND OF THE INVENTION

1. Field of Application

The present invention relates to a method of image display in which data representing a single main image are held in a main memory and in which a portion of the data are selectively transferred to a display memory, to be used in displaying a portion of the main image while enabling scrolling of the displayed portion across the main image.

The term "main image" is used herein in a very general sense, e.g. to include a single graphic image, a single page of text formed of characters, an array of multiple pages of text or graphics, etc.

2. Prior Art Technology

In the prior art, methods of image display are known in which data representing a main image are held stored in a main memory, and in which a selected portion of the data are transferred temporarily to a display memory, and the contents of the display memory are displayed by a display device. In general, the amount of image data which can be displayed at one time by the display device is substantially smaller than the main image data held in the main image memory, so that only a small portion of the contents of the main image memory are transferred to the display memory, i.e. the display memory will generally have a smaller storage capacity than the main image memory.

FIG. 1 is a conceptual diagram for illustrating the basic principles of such a prior art method of image display. Numeral 401 denotes a main image memory, having data representing a main image stored therein. 402 denotes a region within the main image memory 401 in which is stored a set of data representing a portion of the main image, with the data 402 having been transferred to a display memory 403 to be temporarily held therein, while being displayed by the display device 406. It will be assumed that the system includes hardware whereby it is possible to selectively display the data held in the display memory 403 in a non-expanded mode, in which those data fill the display area of the display device 406, or an expanded mode, in which a portion of the data held in the display memory 403 (indicated by the broken-line rectangle 405) are displayed such as to fill the display area. In that case, for example assuming a condition of 1:1 relationship between respective image data and the pixels of the display device 406 in the non-expanded display mode, expansion by a factor of 2 (in the horizontal and vertical display directions, referred to in the following as the X and Y directions respectively) would signify that each datum of the region 405 of the display memory 403 will correspond to a specific set of four pixels of the display device 406. Designating the aforementioned expansion factor as m, the expanded image that is displayed in that case by the display device 406 is defined by the value of m and the values of the initial display coordinates Dpx, Dpy, which define a specific datum currently held in the display memory 403 as a display starting point, with respect to the X (horizontal) and Y (vertical) display directions.

More specifically, each datum held in the display memory 403 is defined by a pair of X and Y address coordinates. When the region 405 is displayed in expanded form, the first (e.g. uppermost) line of data of a frame displayed by the display device 406 will be read out from addresses in the display memory 403 which have the Y-coordinate DPy, and succeeding display lines of the frame will be obtained from addresses having successively increasing values of Y-coordinate.

With such a prior art method of image display, it is necessary to transfer large amounts of data between the main image memory 401 and the display memory 403 each time that a change is to be made in the picture displayed by the display device 406, e.g. each time that scrolling movement of the displayed portion of the main image is executed. For example, if a change is to be made from displaying the data of region 402 of the main image memory to displaying the data of region 402', then it is necessary to transfer all of the data of the region 402' to the display memory 403.

SUMMARY OF THE INVENTION

It is an objective of the present invention to overcome the disadvantages of the prior art as set out above, by providing a method of image display whereby the amount of data transfer between the main image memory and the display memory during scrolling operations is minimized.

To achieve the above objective, with the present invention applied to a system including a main image memory having stored therein data representing a main image, a display memory coupled to temporarily hold data transferred thereto from the main image memory, display means for displaying at least a selected portion of the data held in the display memory, and means for controlling selection of the data portion to execute display scrolling, the method of the present invention comprises:

(a) transferring from the main image memory to the display memory at least sufficient data to produce a display picture by the display means;

(b) executing scrolling by selecting successively different portions of the data contents of the display memory to be displayed by the display means; and (c) detecting whether there is insufficient data held in the display memory to execute a current scrolling operation, and if such insufficiency is detected, transferring from the main image memory to the display memory only sufficient data for enabling the current scrolling operation to be executed.

Furthermore with the method of the present invention, preferably only data for one display line or one display column are transferred from the main image memory to the display memory, when required to execute a current scrolling operation.

DESCRIPTION OF PREFERRED EMBODIMENTS

Figure 2:
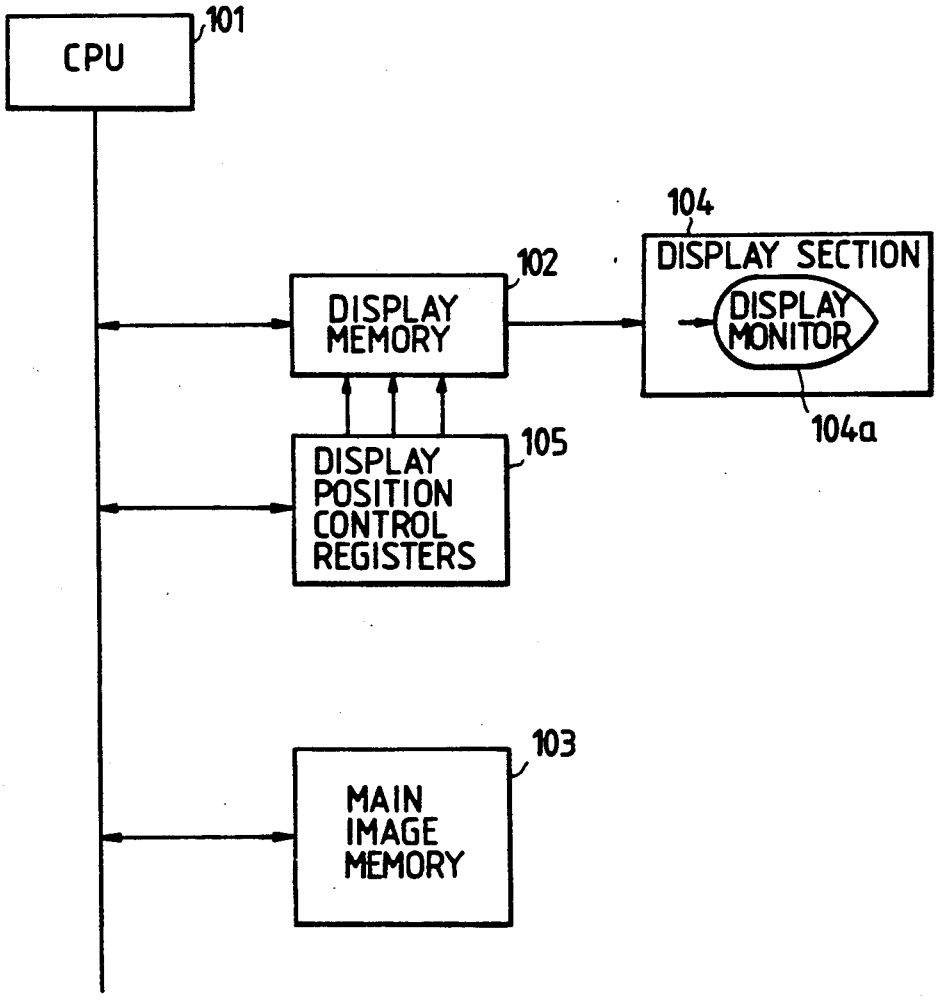
FIG. 2 is a block diagram showing a hardware configuration for implementing the display method of the present invention.

FIG. 2 is a simple block diagram showing the hardware configuration of an apparatus for implementing the image display method of the present invention. Numeral 101 denotes a CPU (central processing unit), 103 denotes a main image memory in which is stored a main image as defined hereinabove, 105 denotes a set of display position control registers, 102 denotes a display memory, and 104 denotes a display section which includes a display monitor 104*a*. The display section 104 functions to insert the contents of the display memory 102 (or a selected portion of these contents, in the case of an expanded display mode) into successive frames of a video signal which is supplied to the display monitor 104*a*, for thereby displaying the data from the display memory 102.

Figure 3:
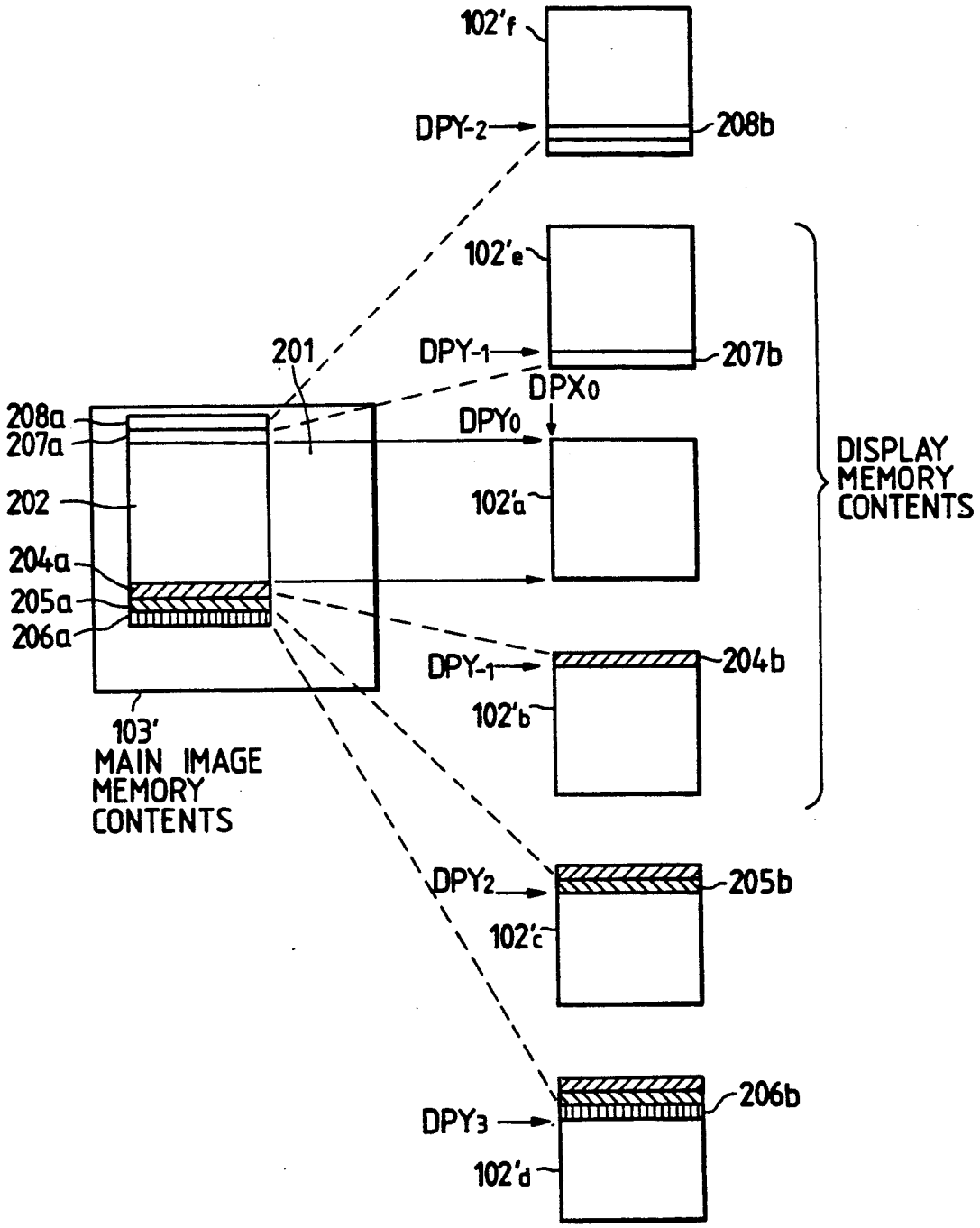
FIG. 3 is a conceptual diagram for illustrating a method of scrolling with the present invention.
Figure 4:
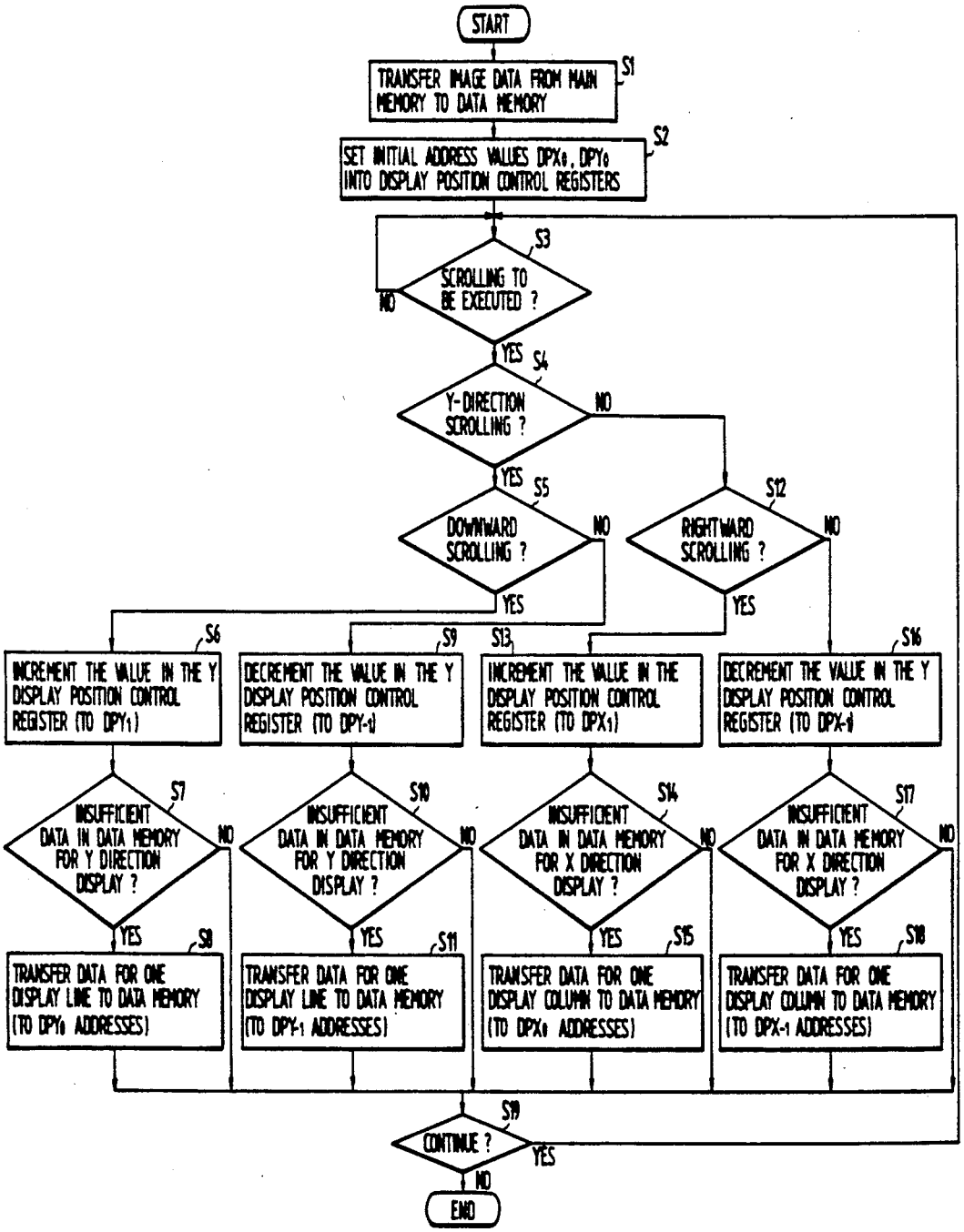
FIG. 4 is a flow chart for illustrating the operation of a CPU in the apparatus of FIG. 2.

FIG. 3 is a conceptual diagram and FIG. 4 is an operation flow chart for assistance in describing the operation of the method of the present invention, in conjunction with the block diagram of FIG. 2. In FIG. 3, the large rectangle 103' represents the contents of the main image memory 103, while the small rectangles 102'*a* to 102'*f* denote the contents of the display memory 102 under respectively different conditions of scrolling. The addresses of the main image memory 103 and display memory 102 will be assumed to each be configured as an array in which each address is defined by a pair of X and Y coordinates, respectively corresponding to the display X and Y directions. Thus, respective (X-direction) rows of addresses in the display memory 102 correspond to display lines of the display monitor 104*a*, and respective (Y-direction) columns of addresses in the display memory 102 correspond to display columns. It will first be assumed that data represented by the region 202 of the main image held in the main image memory 103 have been transferred to the display memory 102 (i.e. as the region 102'*a*) and are being displayed by the display monitor 104*a*. In that condition, the initial address value for display scanning is $DPY_0$, $DPX_0$. That is to say, the values $DPY_0$, $DPX_0$ have been set into respective ones of the display position control registers 105, so that in each frame of the video signal that is supplied to the display monitor 104*a*, the first datum to be displayed (e.g. at the uppermost left position of the top line of displayed data) will be taken from the address $DPX_0$, $DPY_0$ of the display memory 102, i.e. the data from addresses $\{DPY_0, DPX_0\}$, $\{DPY_0, DPX_1\}$, $\{DPY_0, DPX_2\}$, . . . will appear as the uppermost display line, and subsequent display lines will be from the Y-addresses $DPY_1$, $DPY_2$, . . . . Thus, the portion of the main image represented by the contents of region 202 of the main image memory 103 will be displayed by the display monitor 104*a*.

The operation will now be described for the case in which downward scrolling is to be executed of this displayed portion of the main image, referring to the flow chart of FIG. 4 for the operation of the CPU 101. The scrolling may be executed for example in response to an externally supplied command from an input device such as a keyboard (not shown in FIG. 1). It is assumed in this example of FIG. 3 that the display expansion factor m is equal to 1, i.e. no display expansion is executed, so that the display region is filled with the contents of the display memory 102. More specifically in this condition, when the data of the region 202 are held in the display memory 102 (i.e. as indicated by 102'*a* in FIG. 3), the first (uppermost) display line of the display monitor 104*a* corresponds to the set of addresses of the display memory 102 having the Y-coordinate $DPY_0$, while the first (leftmost) display column of the display monitor 104*a* corresponds to the set of addresses of the display memory 102 having the X-coordinate $DPX_0$. The steps S1 and S2 of FIG. 4 are executed to set the data of region 202 in FIG. 3 into the display memory 102, and to set the address values $DPX_0$, $DPY_0$ into the display position control registers 105 as described above. If scrolling is to be executed, then a "yes" decision is reached in step S3, and if this is to be downward scrolling, then "yes" decisions are made also in steps S4, S5. To scroll downward by one display line, it is necessary to first set a new value of Y-direction starting address coordinate into the display position control registers 105, i.e. the value $DPY_1$, while leaving the X-direction starting coordinate unchanged as $DPX_0$ (step S6), and to transfer the set of data 204*a* from the main image memory 103 to the 102*b* (step S8). When scrolling is executed in the non-expanded display mode, it will always be necessary to transfer data from the main image memory 103 to the display memory 102 each time that scrolling by one line (or column) is executed. However as described hereinafter, that is not necessarily true in the case of operation in the expanded display mode, so that a decision is made (step S7) as to whether such a data transfer is necessary.

The data 204*a* from the main image memory 103 (i.e. data for one display line) are thereby stored in the set of addresses of the display memory 102 having the Y-coordinate $DPY_0$ (i.e. the addresses $\{DPY_0, DPX_0\}$, $\{DPY_0, DPX_1\}$, $\{DPY_0, DPX_2\}$, . . . ) as data 204*b*. This change in the contents of the 102*b* and the display position control registers 105 is executed during a vertical blanking interval of the video signal that is supplied to the display monitor 104*a*. At the start of each frame of the video signal thereafter, the contents of the addresses in the display memory 102 having the Y-address $DPY_1$ will be displayed by the display monitor 104*a* as the uppermost display line, while the new data 204*b* will form the last display line. Thus, scrolling downward by one line across the main image stored in the main image memory 103 has been executed.

At this stage, the contents of the display memory 102 are as indicated by 102'*b* in FIG. 3.

If now further scrolling in the vertically downward direction is to be executed (so that there is a "yes" decision in step S19 of FIG. 4), operation again proceeds around the loop of steps S3 to S8 and S19. In this case, the data line 205*a* from the main image memory 103 is written (as the data 205*b*) into the set of locations in the display memory 102 having the Y-coordinate address $DPY_1$, while the starting Y-address value held in the display position control registers 105 is incremented by one, i.e. is set to $DPY_2$. The contents of the display memory 102 are now as indicated by 102'*c*. Thereafter during each frame interval, the first line of the display will consist of the data having the Y-address $DPY_2$, and the last line of the display will consist of the new data 205*b*.

Similarly, 102'*d* shows the condition of the contents of the display memory 102 if a further scrolling operation in the downward direction by one line is executed, so that the data 206*a* are stored in the display memory 102 as data 206*b*, and the new Y-direction display starting address is set in the display position control registers 105 as $DPY_3$.

If scrolling in the upward direction is to be executed, then a "no" decision will be made in step S5 of the flow chart, so that steps S9, S10 and S11 will be executed. In step S9 the Y-address value held in the display position control registers 105 is decremented by one, to be changed from $DPY_0$ to $DPY_{-1}$ (i.e. the final Y-address of the display memory 102, since these addresses are cyclically read out in successive frame intervals of the video signal which drives the display monitor 104*a*). The data 207*a* for one display line are then transferred from the main image memory 103 to the display memory 102, and written therein into the Y-address $DPY_{-1}$, as data 207*b*. Thereafter during each frame interval of the video signal, the first display line will consist of the data 207*b*, and the last display line will consist of the contents of the Y-addresses $DPY_{-2}$ of the display memory 102 (i.e. the addresses $\{DPY_{-2}, DPX_0\}$, $\{DPY_{-2}, DPX_1\}$, $\{DPY_{-2}, DPX_2\}$, . . . ) so that upward scrolling by one line has been executed. The contents of the display memory 102 are now as indicated by 102'*e*.

If now further scrolling in the vertically upward direction is to be executed (so that there is a "yes" decision in step S19 of FIG. 4), operation again proceeds around the loop of steps S3 to S5, S9 to S11, and S19. In this case, the data line 208*a* from the main image memory 103 is written (as the data 208*b*) into the set of locations in the display memory 102 having the Y-coordinate address $DPY_{-2}$, while the starting Y-address value held in the display position control registers 105 is set to $DPY_{-2}$. The contents of the display memory 102 are now as indicated by 102'*f*. Thereafter during each frame interval, the first line of the display will consist of the data having the Y-address $DPY_{-2}$, and the last line of the display will consist of the contents of the Y-addresses $DPY_{-3}$.

The operation for scrolling in the horizontal (X) display direction (i.e. when there is a "no" decision in step S4 of the flow chart) is basically identical to that described above, but with data for one display column being transferred from the main image memory 103 to the display memory 102 (in steps S15 or S18) each time that scrolling to the left or right by one column is to be executed, and with a new X-address being set into the display position control registers 105 (in step S13 or S16) as the X-direction display starting address, with the Y-address in the display position control registers 105 being left unchanged.

It will be apparent that the method enables scrolling in any arbitrary direction to be easily executed, as a combination of scrolling in the X and Y directions.

The address values $DPY_1$, $DPX_1$, etc. which appear in FIG. 4 each apply only to the first time that operation proceeds from step S3 to S19 (e.g. via the steps S4 to S8), and are inserted only for ease of understanding.

Figure 1:
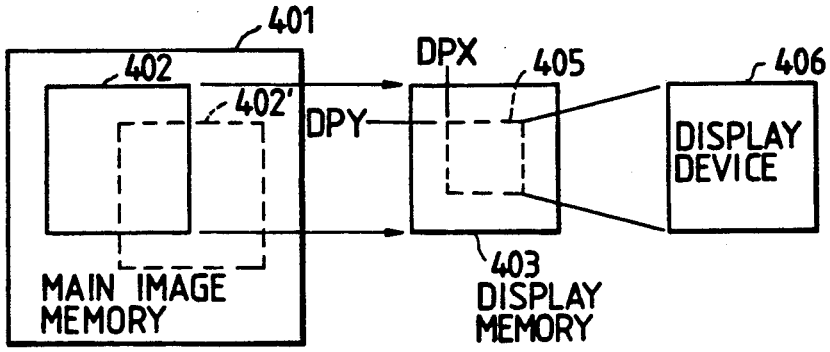
FIG. 1 PRIOR ART
FIG. 1 is a conceptual diagram for describing a prior art method of image display.
Figure 5A:
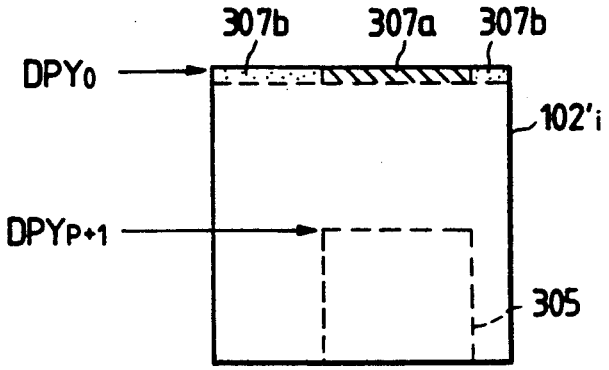
FIGS. 5A to 5C are conceptual diagrams for illustrating scrolling in the case of expanded image display, with the method of the present invention.
Figure 5B:
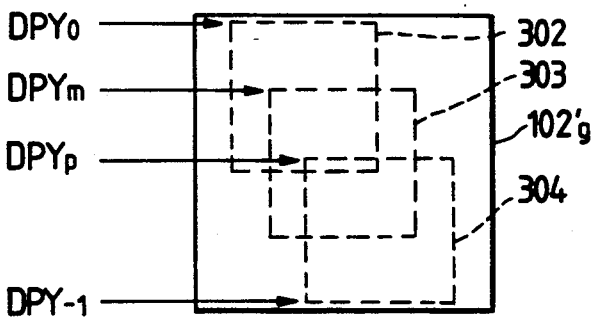
Figure 5C:
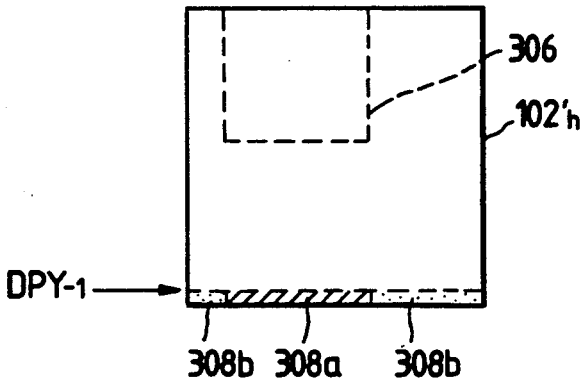

The scrolling operation will now be described for the case in which display expansion (as illustrated in FIG. 1 and described hereinabove) is executed, i.e. the display expansion factor m is made greater than one, referring to FIGS. 5A to 5C and to the flow chart of FIG. 4. In FIGS. 5A to 5C the contents of the display memory 102 are indicated by the rectangles 102'*i*, 102'*g* and 102'*h* respectively. It will be assumed that the value of m is made equal to 2, i.e. there is display expansion by the factor 2 in both the X and Y directions. It will also be assumed that an initial condition has been established (e.g. by steps S1, S2 of FIG. 4) whereby the data of rectangle 102'*g* have been transferred from the main image memory 103 to the display memory 102 and the display starting address values $DPY_m$, $DPX_n$ have been set in the display position control registers 105, so that the contents of the region 303 of the display memory 102 are now being displayed by the display monitor 104*a*. In this condition, scrolling can be executed in any arbitrary direction without the need to transfer further data from the main image memory 103 to the display memory 102, so long as the limits of the region 102'*g* are not exceeded, e.g. diagonal scrolling from the region 303 to the region 302 (having first Y-coordinate value $DPY_0$) or from region 303 to region 304 (having first Y-coordinate value $DPY_p$ and final Y-coordinate value $DPY_{-1}$) is possible without the need for such a data transfer. That is to say, in such a condition there will be a "no" decision reached in step S7 (or S10, S14, S17) of FIG. 4, each time that scrolling by one display line or column is to be executed.

If scrolling is to be continued beyond the boundaries of the data region 102'*g*, then it becomes necessary to transfer data for one display line or column from the main image memory 103 to the display memory 102. If for example further downward scrolling is to be executed from the condition in which the contents of region 304 are being displayed, then data for one line (307*b*) are transferred from the main image memory 103 to the display memory 102, although only the portion 307*a* of that data will be actually used in the expanded display picture, and the display starting Y-address is incremented to $DPY_{p+1}$. That is to say, after executing step S6 of FIG. 4, there will be a "yes" decision in step S7, so that data transfer will be executed in step S8. The contents of the display memory 102 will now become as indicated by 102'*i* in FIG. 5A. Thereafter, the first line of the display appearing on the display monitor 104*a* will consist of data in the $DPY_{p+1}$ addresses of the region 305 in FIG. 5A, while the final display line will consist of the data in portion 307*a*.

Conversely, if upward scrolling is to be executed from the data region 302 in FIG. 5B, then the Y-value held in the display position control registers 105 will be decremented by one in step S9 of the flow chart (to become $DPY_{-1}$), and a "yes" decision reached in step S10. Thus, data 308*b* for one display line will be transferred from the main image memory 103 to the display memory 102, and the portion 308*a* of that data will be utilized as the first display line. The contents of the display memory 102 will now be as indicated by rectangle 102'*h* in FIG. 5C.

Similar operations will be executed if scrolling in the X direction occurs such that the expanded display region is moved outside the data region 102'G of FIG. 5B, i.e. with a column of data being transferred from the main image memory 103 to the display memory 102 (step S15 or S18 in FIG. 4) and appropriate updating of the starting X-address value that is set in the display position control registers 105 (step S13 or S16 in FIG. 4).

It can be understood from the above that when operation is executed in the expanded display mode, the method of the present invention ensures that display scrolling can be executed whereby only a minimum of data transfer operations occur between the main image memory 103 and display memory 102, with no data transfers being necessary so long as the range of scrolling does not exceed the boundaries of the data region currently held in the display memory 102, and with only data for one line (or column) of the display being transferred to the display memory 102 each time that these boundaries are exceeded. The method thereby enables scrolling to be smoothly executed in a simple manner, and is thus preferable to prior art methods in which large amounts of data must be transferred to the display memory each time a change occurs in the contents of the display.

What is claimed is:

1. A method of data display for a system including a main image memory having stored therein data representing a main image, a display memory coupled to temporarily hold data transferred thereto from the main image memory, display means for displaying at least a selected portion of the data held in the display memory, and means for controlling selection of the data portion to execute display scrolling, the method comprising:

(a) transferring from the main image memory to the display memory at least sufficient data to produce a display picture by the display means;

(b) executing scrolling by selecting successively different portions of the data contents of the display memory to be displayed by the display means; and (c) detecting whether there is insufficient data held in the display memory to execute a current scrolling operation, and if such insufficiency is detected, transferring from the main image memory to the display memory only the data to be newly displayed for the scrolling operation.

2. A display method according to claim 1, wherein said data transferred from the main image memory to the display memory to be newly displayed consist of data for producing one horizontal display line or one vertical display column of a picture that is generated by the display means.

* * * * *